United States Patent [19]

Arnsteiner

[11] Patent Number: 5,035,442

[45] Date of Patent: Jul. 30, 1991

[54] SKI WITH A DAMPING ELEMENT

[75] Inventor: Anton Arnsteiner, Mittersill, Austria

[73] Assignee: Blizzard Ges. m.b.H., Mittersill, Austria

[21] Appl. No.: 444,359

[22] Filed: Dec. 1, 1989

[30] Foreign Application Priority Data

Dec. 1, 1988 [DE] Fed. Rep. of Germany ..... 3840553

[51] Int. Cl.[5] ..... A63G 5/07

[52] U.S. Cl. ..... 280/602

[58] Field of Search ..... 280/602, 608, 609, 610

[56] References Cited

U.S. PATENT DOCUMENTS 4,697,820 10/1987 Hayashi et al. ..... 280/602

FOREIGN PATENT DOCUMENTS 0188985 7/1986 European Pat. Off. .
1960684 6/1970 Fed. Rep. of Germany .
2634748 2/1978 Fed. Rep. of Germany .
48312 12/1983 Fed. Rep. of Germany ..... 280/602
3314579 12/1983 Fed. Rep. of Germany .
2534479 4/1984 France .
2615404 11/1988 France .

*Primary Examiner*—Andres Kashnikow
*Assistant Examiner*—Richard Camby
*Attorney, Agent, or Firm*—Fleit, Jacobson, Cohn, Price, Holman & Stern

[57] ABSTRACT

In the context of a ski with a damping layer or sheet of viscoelastic material attached to its surface, the invention seeks to provide improved damping properties and achieves this since the layer or sheet is arranged to extend continuously from the zone of the shovel as far as the end zone of the ski.

20 Claims, 4 Drawing Sheets

SKI WITH A DAMPING ELEMENT

The invention relates to a ski with a layer or a sheet of viscoelastic material attached to its surface for damping vibrations.

The European patent (EP-PS) 188,985 describes a ski of this type which on its surface has at least one strip-like sheet for damping vibrations having a length of between 5 and 20 cms. and arranged either at the end of the ski, at the inner end of the ski shovel or in the zone in front of the binding.

One object of the invention is to devise a ski of the initially mentioned type with enhanced damping properties.

In order to achieve this or other aims, in the invention the layer or the sheet of damping material extends continuously from the shovel zone as far as the end zone of the ski.

It is preferred for the layer or the sheet to extend from the zone in front of the curvature of the shovel, that is to say adjacent to the inner end of the shovel, as far as an end zone of the ski, which is generally at the same distance from the ski end as the front end of the layer or sheet is from the tip of the ski.

It is convenient if the layer or the sheet has a broader middle zone and narrower end zones.

The layer or the sheet may consist of an essentially rectangular middle part and essentially rectangular narrower end parts. The end zones of the narrower end parts of the layer or sheet may continuously become wider towards their ends.

In accordance with another possible form of the invention the layer or sheet may have lateral edges drawn in the form of a curve and which converge from the broadest middle zone with a continuous decrease in breadth of the layer or sheet towards the ends with the formation of points at the ends.

The layer or sheet may furthermore have edges with a generally sinusoidal form so that there is a middle broader zone merging with waisted parts and following such waisted parts widens towards its ends.

It is convenient if the layer or sheet has a multi-ply structure. The plies may consist of plastic, fiber-reinforced plastic or metal.

The layers may be arranged symmetrically or asymmetrically with respect to the median line of the ski.

The invention furthermore contemplates an arrangement in which the layers or sheets differ in stiffness on the two sides of the median line of the ski. The inner zone may consist of stiff and/or hard material and the outer part or zone may consist of soft and/or elastic material. This design leads to a ski with a torsionally stiff inner edge and a torsionally softer outer edge, something that means that the desired different edge engagement is provided for.

The layer or the sheet may be bonded to the upper ply or the upper plies of the ski.

The layer or sheet may however be joined to the ski by means of bolts or screws having heads, whose shanks are fitted into slots (which extend in the length direction of the ski) in the layer or sheet. The slots may be arranged in two rows which are parallel to each other.

Working embodiments of the invention will now be described with reference to the drawings.

FIG. 1*a* is a plan view of a ski with a damping sheet secured thereto.

FIG. 1*b* is a side elevation of the ski in accordance with FIG. 1*a*.

FIG. 1*c* is cross section taken through the middle zone of the ski shown in FIGS. 1*a* and 1*b*.

FIG. 5*a* to

Figure 5A:
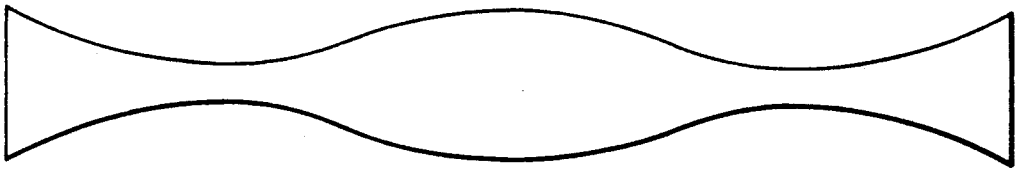
Figure 5B:
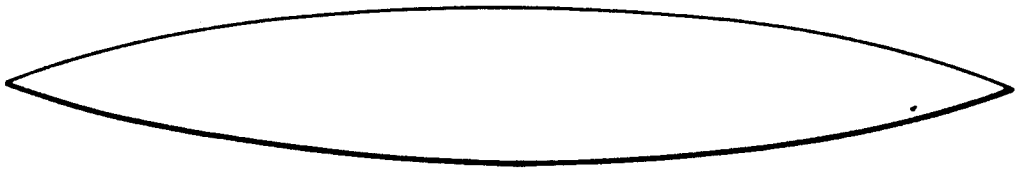
Figure 5C:
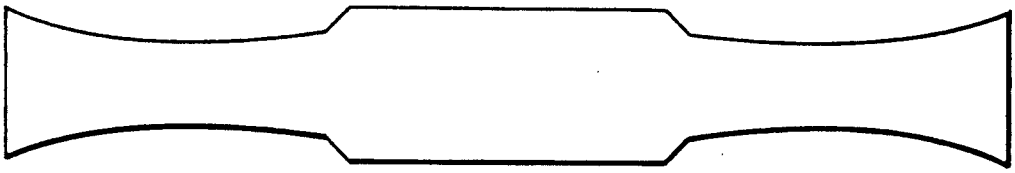

FIG. 5*c* show different possible forms of the damping sheet.

Figure 6:
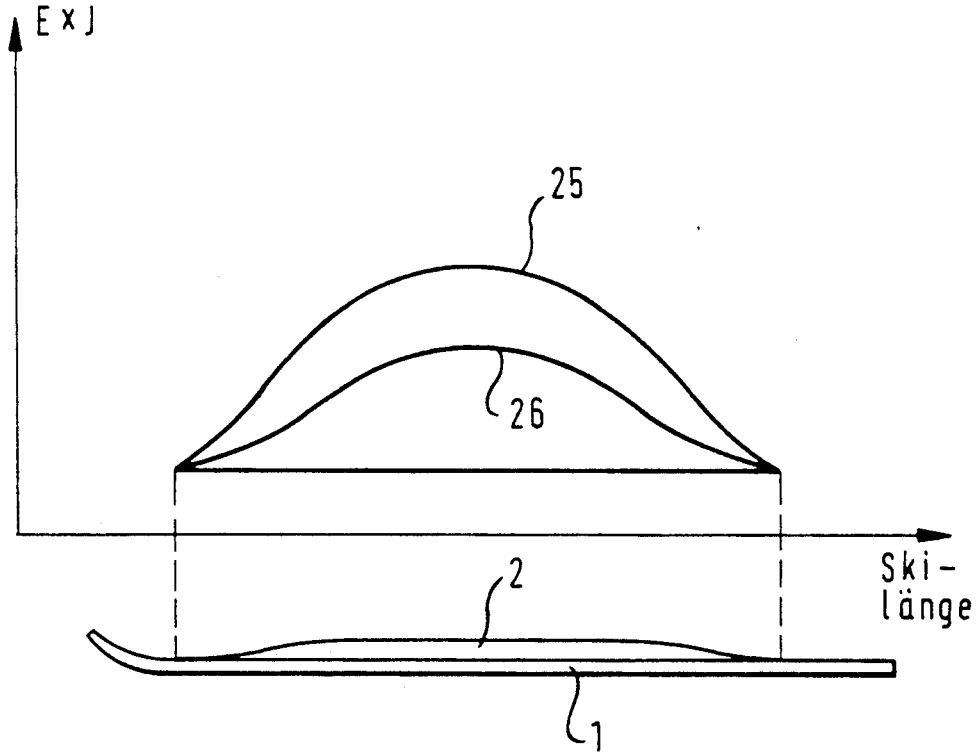

FIG. 6 shows the variations in stiffness over the ski in the form of a graph.

Figure 1A:
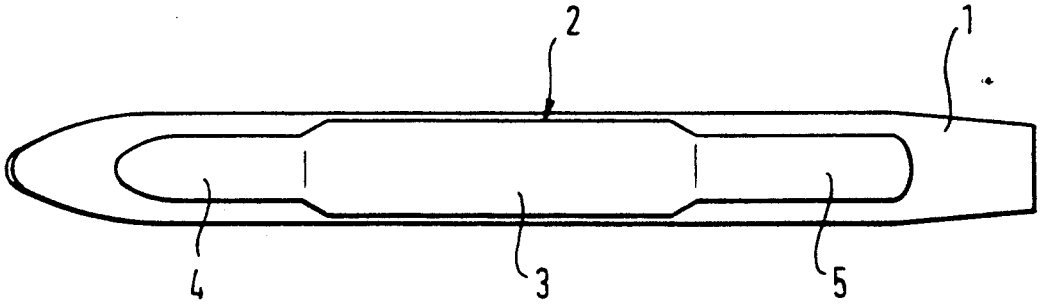
Figure 1B:
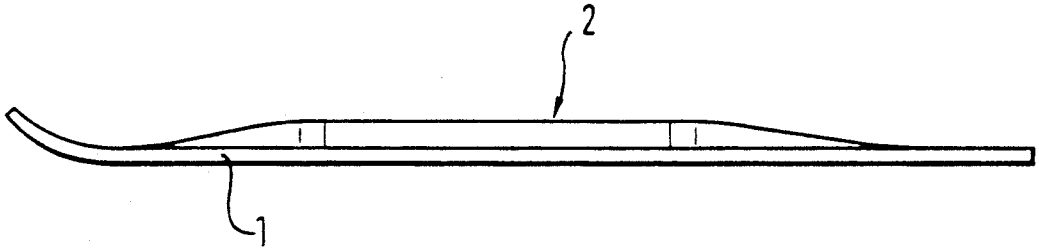
Figure 1C:
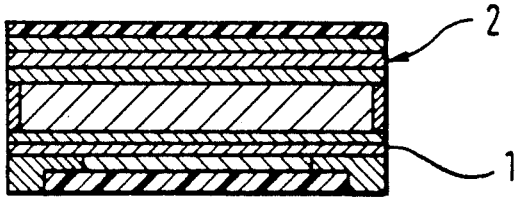

In the embodiment of the invention shown in FIGS. 1*a* through 1*c* the basic member 1 of the ski is connected with a damping sheet 2. This damping sheet 2 has a broader and generally rectangular middle zone 3 and narrower end zones 4 and 5 which are also generally rectangular. Towards the ends the layer or sheet 2 is preferably such that it decreases in thickness in the manner indicated in FIGS. 1*b* and 6 so that the layer or sheet 3 merges with the surface of the ski in a generally smooth, stepless manner.

As will be seen from FIG. 1*c*, the basic member 1 of the ski has a conventional structure, as for instance in the form of a box and/or of sandwich. The damping sheet 2 has a structure involving the presence of a plurality of plies or layers.

Figure 2:
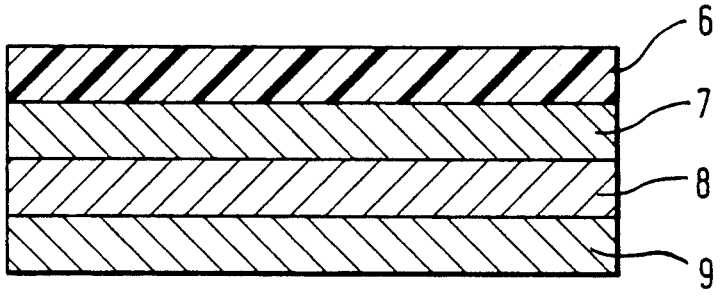
FIG. 2 is an enlarged representation of the cross section through the damping layer.

The structure of a first possible embodiment of the sheet will now be explained in more detail with reference to FIG. 2, which shows a cross section in relation to the longitudinal axis of the ski, through the sheet. The sheet consists of 4 plies, that is to say the uppermost ply 6 of a plastic with a modulus of elasticity of $10^3$ to $10^4$ N/mm$^2$ and of further plies 7 through 9, which consist of fiber-reinforced plastics or metals or metal alloys with a modulus of elasticity of $1.5 \cdot 10^4$ to $9 \cdot 10^4$ N/mm$^2$.

Figure 3:
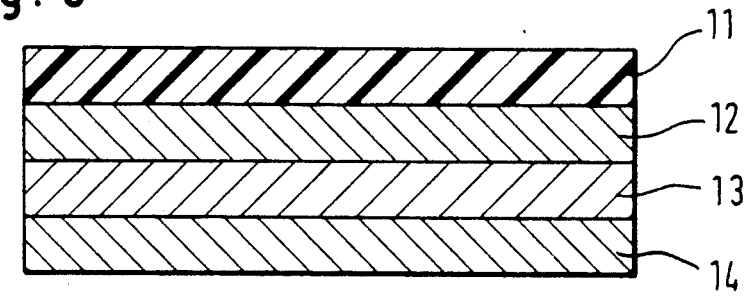
FIG. 3 is an enlarged representation of a damping layer or sheet of another embodiment of the invention.

In FIG. 3 the reader will see a further working embodiment of the structure of the sheet. In accordance with this embodiment two of the layers 11 through 14 consist of layers with a modulus of elasticity between $1.5 \cdot 10^3$ to $9 \cdot 10^3$ N/mm$^2$ and the other two layers consist of material with a substantially lower modulus of elasticity, as for instance between $10^2$ and $10^3$ N/mm$^2$. The arrangement of the layers in relation to each other is quite uncritical.

Figure 4:
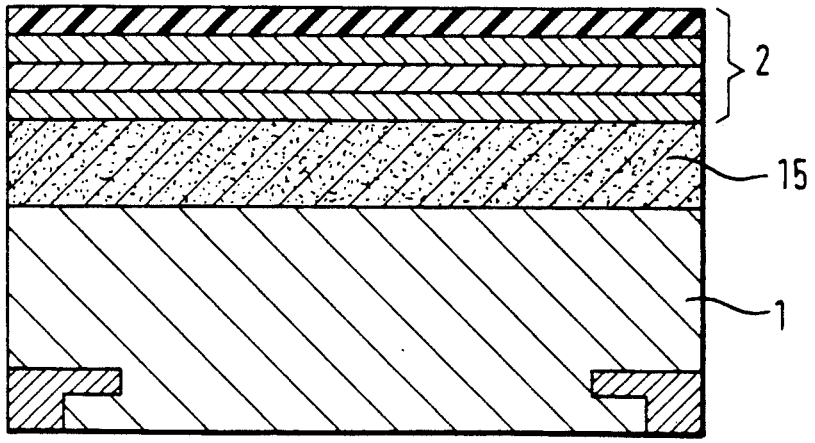
FIG. 4 shows a cross section similar to that of FIG. 1*c* of a ski with a flexible connecting layer.

In the embodiment of the invention shown in FIG. 4 the sheet 2 is joined to the ski by means of a flexible layer 15. The connection may be in the form of a screw connection. Or it may be in the form of an adhesive bond. In this case the layer 15 preferably has a modulus of elasticity of between $10^2$ and $10^3$ N/mm$^2$.

FIGS. 5*a* through 5*c* indicate different forms of the damping sheet.

FIG. 6 is a graph of the variations in stiffness in a ski, on whose surface a damping sheet or layer in accordance with the invention has been bonded. The curve 26 represents the variation in the basic ski stiffness after the application of a soft damping element or sheet and curve 25 shows the change after the attachment of a hard damping element or damping sheet.

I claim:

1. A ski comprising a ski body, a layer or sheet attached to an uppermost surface of said ski body, said layer or sheet being adapted to damp vibrations and being made of a viscoelastic material, said layer or sheet extending continuously from a zone of a shovel of said ski body to an end zone of said ski body, said layer or sheet extending from a zone in front of said shovel to said end zone, extending to a distance from an end of said ski body equal to a distance the layer or sheet extends from a ski tip of the ski body, said layer or sheet having a broad middle zone and a narrow end zone, the layer or sheet includes an essentially rectangular middle zone and essentially rectangular narrower end zones.

2. The ski as claimed in claim 1, wherein the end zones of the narrower end zones of the layer or sheet continuously widen towards their ends.

3. The ski as claimed in claim 1, wherein the layer of the sheet has lateral edges drawn in the form of a curve and which converge to form terminal points from the broadest middle zone with a continuous decrease in breadth of the layer or sheet towards the ends.

4. A ski comprising a ski body, a layer or sheet attached to an uppermost surface of said ski body, said layer or sheet being adapted to damp vibrations and being made of a viscoelastic material, said layer or sheet extending continuously from a zone of a shovel of said ski body to an end zone of said ski body, said layer or sheet extending from a zone in front of said shovel to said end zone, extending to a distance from an end of said ski body equal to a distance the layer or sheet extends from a ski tip of the ski body, said layer or sheet having generally sinusoidal edges such that a middle broad zone widens following waists towards the ends.

5. The ski as claimed in claim 4 wherein the layer or the sheet has a multi-ply structure.

6. The ski as claimed in claim 5, wherein the plies are selected from the group including plastic, fiber reinforced plastic and metal.

7. The ski as claimed in claim 6 wherein the layer or sheet is arranged symmetrically to the median line of the ski.

8. The ski as claimed in claim 6 wherein the zones of the layer or sheet on the two sides of the median line consist of materials of different stiffness.

9. The ski as claimed in claim 8, wherein ends and edges of the layer or sheet are rounded to steplessly merge with the uppermost surface of the ski body.

10. A ski with a torsionally stiff inner edge and a torsionally soft outer edge as claimed in claim 8, wherein the inner zone of the layer or sheet is selected from the group of stiff and hard materials and the outer zone is selected from the group of soft and elastic materials.

11. The ski as claimed in claim 10, wherein the layer or the sheet is adhesively bonded to the ski.

12. The ski as claimed in claim 10, wherein that the layer or the sheet is attached to the ski by bolts or screws having heads, the shanks of same fitting through slots aligned with the longitudinal direction of the ski.

13. The ski as claimed in claim 12, characterized in that the slots are arranged in two rows which are parallel to each other.

14. A ski comprising:

a ski body, a layer or sheet attached to an uppermost surface of said ski body, said layer or sheet being adapted to damp vibrations and being made of a viscoelastic material, said layer or sheet extending continuously from a zone of a shovel of said ski body to an end zone of said ski body, said layer or sheet extending from a zone in front of said shovel to said end zone, extending to a distance from an end of said ski body equal to a distance, the layer or sheet extends from a ski tip of said ski body, said layer or sheet having generally sinusoidal edges such that a middle broader zone widens following waists towards the ends, said layer or the sheet has a multi-ply structure, and plies of said multi-ply structure are selected from the group of plastic, fiber reinforced plastic, and metal.

15. The ski as claimed in claim 14, wherein the layer or sheet is arranged symmetrically to a median line of the ski.

16. The ski as claimed in claim 18, wherein the layer or the sheet is arranged asymmetrically to a median line of the ski.

17. The ski as claimed in claim 14, wherein zones of the layer or sheet on two sides of a median line consist of materials of different stiffness.

18. The ski as claimed in claim 14, wherein ends and edges of the layer or sheet are rounded to steplessly merge with the uppermost surface of the ski body.

19. A ski with a torsionally stiff inner edge and a torsionally soft outer edge as claimed in claim 17, wherein an inner zone of the layer or sheet is selected from the group including stiff and hard materials and the outer zone is selected from the group including soft and elastic materials.

20. The ski as claimed in claim 14, wherein the layer or the sheet is adhesively bonded to the ski.

* * * * *